US006746226B2

(12) United States Patent
Moore

(10) Patent No.: US 6,746,226 B2
(45) **Date of Patent: *Jun. 8, 2004**

(54) SPINNERETTE ASSEMBLY FOR FORMING MULTICOMPONENT HOLLOW FIBERS

(75) Inventor: Samuel Earl Moore, Middletown, DE (US)

(73) Assignee: L'Air Liquide - Societe Anonyme à Directoire et Conseil de Surveillance pour l'Etude et l'Exploitation des Procedes Georges Claude, Paris (FR)

( * ) Notice: Subject to any disclaimer, the term of this patent is extended or adjusted under 35 U.S.C. 154(b) by 16 days.

This patent is subject to a terminal disclaimer.

(21) Appl. No.: 09/733,303

(22) Filed: Dec. 8, 2000

(65) Prior Publication Data

US 2002/0070476 A1 Jun. 13, 2002

(51) Int. Cl.[7] ..... D01D 5/24

(52) U.S. Cl. ..... 425/131.5; 425/382.2; 425/463; 425/DIG. 27

(58) Field of Search ..... 425/382.2, DIG. 217, 425/463, 131.5; 264/172.11, 172.15, 541, 171.27

(56) References Cited

U.S. PATENT DOCUMENTS 2,818,034 A * 12/1957 Kinkead ..... 425/463
3,526,571 A * 9/1970 Ogata ..... 428/373
3,849,044 A * 11/1974 Ando et al. ..... 425/131.5
4,493,629 A * 1/1985 Goffe ..... 425/192 S
5,320,512 A * 6/1994 Moore, Sr. ..... 425/131.5

* cited by examiner

*Primary Examiner*—Robert Davis
*Assistant Examiner*—Joseph S De Sole
(74) *Attorney, Agent, or Firm*—Linda K. Russell; Elwood L. Haynes

(57) ABSTRACT

The invention provides a spinnerette assembly for forming multicomponenthollow fibers of the sheath/core type. The spinnerette assembly contains an extrusion orifice and a core forming material passage in communication with the extrusion orifice. A hollow needle extends through the extrusion orifice in a concentric manner to define an annular passage surrounding the needle. The core forming material passage includes a core forming material inlet port extending from a surface of the spinnerette assembly to an interior of the assembly and a transverse passage extending from the core forming material port to the annular passage surrounding the needle. A bore forming fluid passage communicates with the interior of the needle. The spinnerette assembly contains at least one sheath forming material passage also in communication with the extrusion orifice.

19 Claims, 5 Drawing Sheets

SPINNERETTE ASSEMBLY FOR FORMING MULTICOMPONENT HOLLOW FIBERS

FIELD OF THE INVENTION

This invention relates to spinnerette assemblies for forming hollow fibers. It particularly relates to an improved spinnerette for more efficient and precise production of multi-component hollow fibers.

BACKGROUND OF THE INVENTION

It is well known to use various hollow fibers, generally made of one or more polymer materials, for various applications. For example, hollow fibers are used in carpets, as fill materials for pillows, as insulation materials for blankets and garments, and as membranes for gas separation, blood dialysis, purification of water, and other filtering applications. For membrane applications, the hollow fibers may be composed of a single component or a plurality of components, such as a hollow structured core with a sheath disposed around the core acting as a separating layer. The fibers can be bundled together and disposed in a tubular housing to provide a separation device known as a permeator. Ordinarily, the hollow fibers are relatively small, having a diameter on the order of 30 to 1000 micrometers. Accordingly, the apparatus and method for manufacturing hollow fibers must be very precise to be able to control the diameter of the fiber, and the concentricity of the core and sheath around the bore.

Numerous spinning assemblies have been devised for the production of single-component hollow fibers and multi-component hollow fibers of the sheath/core type. Particularly, devices have been proposed for ensuring uniform supply of the fiber-forming fluid or fluids to the orifices of a spinnerette with the object of producing hollow fibers identical in diameter, composition, and concentricity. These spinnerettes use a means for supplying the bore fluid positioned in the spinning orifice for forming the hollow fiber. Usually, a tube or needle is used for this purpose and a gaseous or liquid fluid is injected from the tube, thus forming the bore of the fiber as it is being extruded from the spinnerette orifice. For melt spinning, the nascent fiber can be solidified by cooling in a gaseous or liquid cooling fluid. For solution spinning, the nascent fiber can be solidified by evaporation of the solvent or by contacting the fiber with a solvent-extracting liquid that results in coagulation of the polymer solution(s) to form the fiber wall.

A typical spinning assembly, such as described in U.K. Patent No. 830,441 for a multi-component fiber, comprises a front and back plate spaced apart from but facing each other so as to provide a liquid channel there between. The front plate is provided with an extrusion orifice therethrough, and at least one of the plates, on the side facing the other plate, is provided with a plateau-type protrusion so as to constrict the liquid channel in a region surrounding the extrusion orifice entrance and, thus, cause the stream of the sheath-forming material to converge substantially radially towards the orifice entrance. A tube is positioned in the orifice entrance to supply the bore fluid. However, a continuing problem is the uniform supply of core- and sheath-forming material during the formation of the multi-component fiber. Most spinnerettes of this type are made largely by hand, one at a time. As a result, parts made for one spinnerette will not always fit another spinnerette. When parts are not interchangeable, any damage to one part of the spinnerette assembly may render the entire assembly useless. In assembling or cleaning conventional bicomponent or hollow-fiber spinnerettes, it is very easy to slightly bend the fluid-injection tube or needle, such that it is off center of the spinning orifice. When this happens, the spinnerette cannot be used until repaired.

Another related problem of conventional spinnerettes for multi-component hollow fibers is that the sheath and core of the hollow fiber are not concentric. Concentricity of the sheath and core are important to obtain uniform fibers. Concentricity of the sheath and core was customarily obtained by adjustment of metering surfaces to regulate (meter) the flow of the polymers. The metering surfaces are produced by closely machining two surfaces so as to produce a narrow opening which will effectively meter polymer at a uniform pressure and rate as it is being extruded. U.S. Pat. No. 3,458,615 discloses a method for maintaining sheath/core concentricity by circumferential metering of the polymer sheath to be extruded about the polymeric core involving the creation of an annular wedged-shaped flow of sheath polymer around the axially-contained fluid stream.

In order to maintain the concentricity of fiber diameter and the bore diameter, other spinnerettes have been provided with members for centering the tube and the bore of the spinnerette plate. For example, U.S. Pat. No. 4,493,629 describes a modular spinnerette assembly fitted with multiple screws threaded through the spinnerette plate to center the tube and orifice of the spinnerette. These adjusting screws are unreliable and are prone to error when the spinnerette is disassembled, cleaned and then reassembled. Many devices have been proposed for ensuring uniform supply of homogenous sheath-forming liquid to the orifices of a multi-orifice spinnerette with the object of producing multiple hollow fibers with concentric layers, identical in denier and other characteristics. Such devices usually involve variations in the diameter or the location of orifices and single or multiple spinnerette plates. Lack of concentricity and uniformity remain a problem in the manufacture of such single-component and multi-component fibers.

Another problem with existing spinnerettes is the ability to deliver the polymer fluid or fluids uniformly around the tube or needle within the spinnerette. U.S. Pat. No. 5,320,512 discloses a spinneret that has a plurality of discrete material passages formed around the needle to deliver the polymer fluid around the needle. The polymer fluid from these individual passages must converge and meld together to form a singular annular flow around the tube or needle as the polymer fluid traverses through the main polymer fluid passage. If complete melding is not attained, seams may develop down the length of the fiber at the interfaces where the individual flows did not fully converge.

Therefore, it would be desirable to have a spinnerette design which would permit the production of concentric and uniform fibers without the risk of seaming.

SUMMARY OF THE INVENTION

The present invention provides an improved spinnerette for the production of hollow fibers.

It is an object of the invention to overcome the limitations of conventional spinnerettes.

It is another object of the invention to reduce imperfections in hollow fibers.

It is another object of the invention to extend hollow-fiber production run times.

It is another object of the invention to reduce the time for spinnerette maintenance.

It is another object of the invention to simplify spinnerette fabrication.

It is another object of the invention to produce high quality composite fibers having one or more sheath layers in an efficient manner.

To achieve these objects, a first aspect of the invention is a spinnerette assembly for forming a composite hollow fiber comprising:

at least one extrusion orifice formed in said spinnerette assembly;

a hollow needle extending through each said extrusion orifice in a concentric manner to define an annular passage around said needle in said extrusion orifice;

a bore forming fluid passage communicating with an interior of each said needle;

at least one core forming material passage formed in said spinnerette assembly, wherein each said core forming material passage comprises a core forming material inlet port extending from a surface of said assembly to an interior of said assembly and at least one transverse passage extending from said core forming material port to each said annular passage, wherein a portion of said transverse passage entirely surrounds each said needle in a continuous manner; and at least one sheath forming material passage, wherein each said sheath forming material passage comprises a sheath forming material port extending from a surface of said assembly to each said annular passage.

A second aspect of the invention is a method of forming a composite hollow fiber comprising the steps of:

delivering a core forming material to each annular passage in the spinnerette assembly, said core forming material entering the spinnerette assembly through one or more core forming material inlet ports and passing through the interior of said assembly to a transverse passage, a portion of said transverse passage entirely surrounding each needle in a continuous manner, and through an annular passage in communication with an extrusion orifice, and delivering at least one sheath forming material concentrically around the core forming material as it traverses through each said annular passage, extruding the layered core forming material and at least one sheath forming material through the extrusion orifice and around each said needle, injecting a bore forming fluid into each needle to thereby provide a layered composite fiber comprising a bore forming fluid, a core forming material, and a sheath forming material as it exits the spinnerette assembly through the extrusion orifice, optionally passing the nascent extruded hollow fiber through an air gap, and solidifying the hollow fiber by cooling, solvent evaporation, or solvent extraction.

BRIEF DESCRIPTION OF THE DRAWINGS

The invention is described through a preferred embodiment and the attached drawings in which.

DETAILED DESCRIPTION OF THE PREFERRED EMBODIMENT

Figure 1:
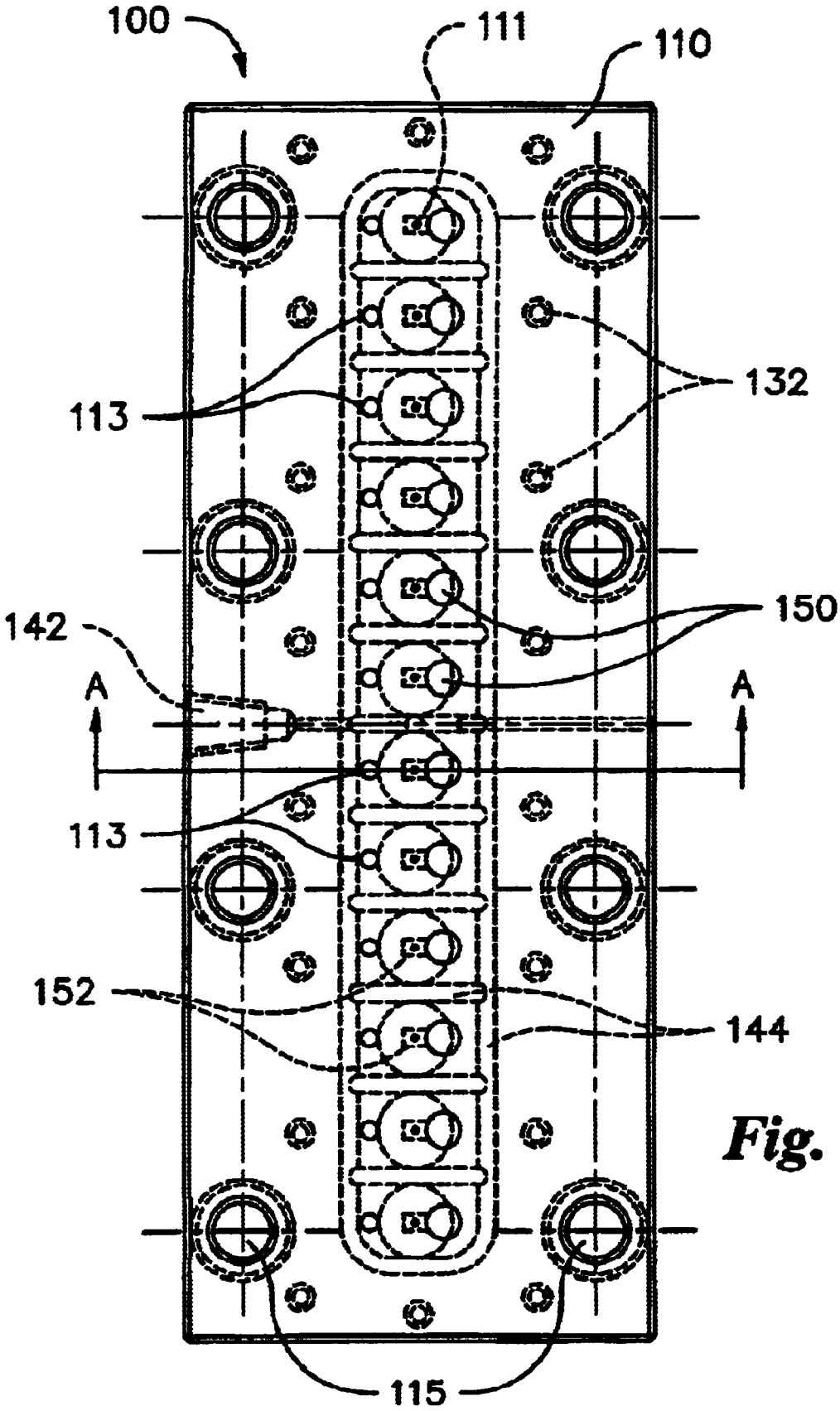
FIG. 1 is a top view of a spinnerette according to a first preferred embodiment of the invention.
Figure 2:
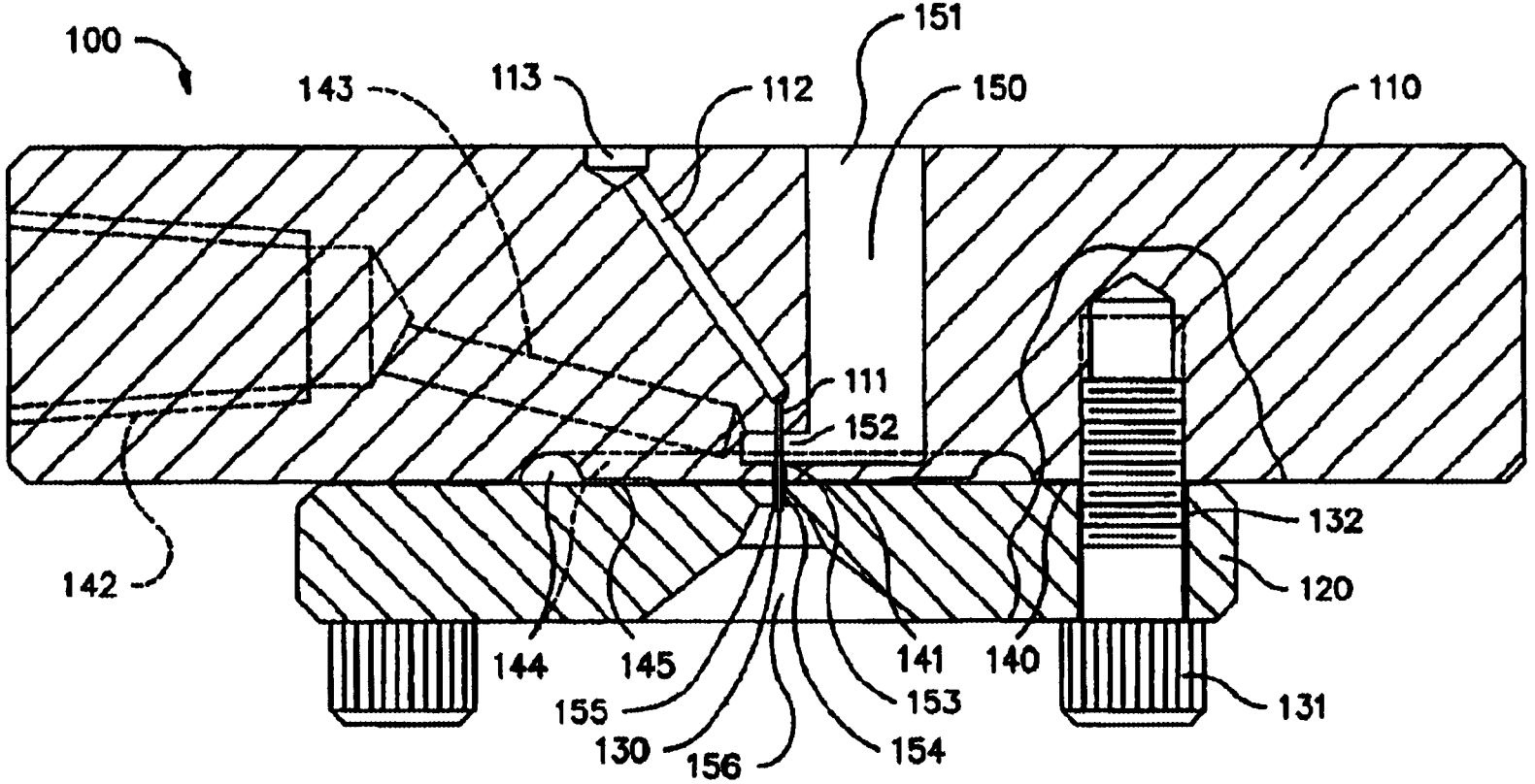
FIG. 2 is a sectional view of the first preferred embodiment taken along line A—A in FIG. 1 showing one extrusion arrangement.

In the first preferred embodiment of the invention for the extrusion of multiple hollow fibers, as illustrated in FIGS. 1 and 2, a spinnerette assembly 100 comprises a spinnerette body 110, bottom plate 120, and needles 130. The specific arrangement shown in FIG. 1 is for simultaneous extrusion of twelve hollow fibers, but the spinneret assembly 100 can be modified to produce a single filament or any number of multiple filaments as may be required. A proximal end of each needle 130 is secured in a respective needle mounting hole 111 formed in spinnerette body 110 by drilling or another machining process. The outer diameter of the proximal end of needle 130 and the diameter of mounting hole 111 preferably are sized such that the proximal end of needle 130 can be pressure fitted into needle mounting hole 111 to secure needle 130 to spinnerette body 110. Needle 130 can be secured to spinnerette body 110 in any appropriate manner that permits access of the bore at the proximal end of needle 130 to the bore forming fluid passages 112 in the spinnerette body 110. Bottom plate 120 is secured to spinnerette body 110 by fasteners 131, such as bolts or the like threaded through holes 132. Channels 144 and 145 formed in the bottom surface of spinnerette body 110 are in communication with gap 141 defined between spinnerette body 110 and bottom plate 120. Shim 140 disposed between spinnerette body 110 and bottom plate 120 defines the dimension of gap 141 that provides uniform delivery of the sheath forming material around the core forming material in a concentric fashion as the core forming material flows through annular passages 153 and 154 respectively. Flared recesses 156 are formed in bottom plate 120 to permit the multiplicity of extruded fibers to exit spinnerette assembly 100 without interference. In the preferred embodiment, the multiple extrusion arrangements are situated in a linear or circular fashion.

Bore forming fluid passage 112 is formed in spinnerette body 110 and extends through spinnerette body 110 to a respective needle mounting hole 111 to be in communication with the passage formed through needle 130. Each bore forming fluid passage 112 includes a bore forming fluid inlet port 113 at the surface of spinnerette body 110. This structure permits a bore forming fluid to be introduced into an extruded fiber to maintain the hollow structure of the extruded fiber in the manner described below.

Core forming material passages 150 are formed in spinnerette body 110 through which a core forming material, such as a polymer material, is delivered to the extrusion orifices 155. Each core forming material passage 150 includes an inlet port 151 that is a hole extending in a direction that is substantially parallel to needle 130. Each core forming material passage 150 also includes a transverse passage 152 that extends from core forming inlet port 151 to a top portion of annular passage 153 that defines the upper portion of extrusion orifice 155. Transverse passage 152 is defined by a backcut portion formed in spinnerette body 110 by a tool inserted through core forming material port 151. Transverse passage 152 extends entirely around needle 130 to permit core forming material to be evenly distributed around needle 130 and evenly introduced into annular passages 153 and 154.

Sheath forming material inlet port 142 and sheath forming material passage 143 are formed in spinnerette body 110 to be in communication with channels 144 to permit sheath forming material to be delivered through sheath forming material inlet port 142 and sheath forming material passage 143, through channels 144 and 145, and through gap 141. As sheath forming material exits gap 141, it is distributed evenly around core forming material at the intersection of gap 141 and annular passage 154.

In operation, spinnerette assembly 100 is mounted to a spinning machine through mounting holes 115 using an appropriate fastening mechanism such as bolts or the like. A bore forming fluid supply, a core forming material supply, and a sheath forming material supply of the machine are coupled respectively to the bore forming fluid inlet port 113, the core forming material inlet port 151, and the sheath forming material inlet port 142. Note that there is one bore forming material inlet port 113 and one core forming material inlet port 151 for each extrusion orifice 155; whereas, one sheath forming material inlet port 142 provides delivery of sheath forming material to each extrusion orifice through sheath forming material passage 143 and channels 144 and 145 and gap 141. These ports can be arranged in any way and can be of any number as is appropriate to deliver the materials to the proper passages. For the spinning of hollow fibers, a core forming material, a sheath forming material, and a bore forming fluid are simultaneously delivered into spinneret 100 at known pressures and flow rates to extrude (i.e., spin) hollow fibers. Typically, the core forming material is injected at about 300–500 psig, the sheath forming material is injected at about 150–300 psig, and the bore forming fluid is injected at about 4–5 psig.

Core forming material travels through core forming material inlet port 151, through the core forming material passage 150, into transverse passage 152, and into upper annular passage 153. At the same time, sheath forming material travels through sheath forming material inlet port 142, through sheath forming material passage 143, and into channel 144. It should be noted that the dimensions of channel 144 are designed to provide sheath forming material at the entrance to each channel 145 at essentially the same pressure so as to provide uniform delivery of sheath forming material through gap 141. At the exit of gap 141, the flow of sheath forming material circumferentially intersects with the flow of core forming material at the gap between the upper and lower annular passages 153 and 154 respectively, thus forming a uniform layer or coating of sheath forming material concentrically around the outer surface of the core forming material. Further, simultaneous with the delivery of the core forming material and the sheath forming material through the spinnerette assembly 100, a bore forming fluid is injected into the bore forming fluid inlet port 113, through bore forming fluid passage 112, and into needle 130. The bore fluid emerges from the distal end of needle 130 at a position within or just downstream of extrusion orifice 155. Since the core forming material and sheath forming material are being simultaneously extruded through the lower annular passage 154 and out of the extrusion orifice 155 concentrically around needle 130 and the emerging bore forming fluid therefrom, the resultant extrudate is a fiber comprised of a bore forming fluid at the center, concentrically surrounded by a core forming material that is concentrically coated with a sheath forming material.

As best illustrated in FIGS. 1 and 2, transverse passage 152 is a backcut portion having a terminal portion that entirely surrounds needle 130 in a continuous manner and is in communication with upper annular passage 153. This construction eliminates the problem of uniform distribution of core forming material around needle 130. It also eliminates the problem of longitudinal seaming down the fiber wall due to incomplete melding of a plurality of core forming material streams within the annular passage as disclosed in U.S. Pat. No. 5,320,512. Also, since the core forming material passage 150 and transverse passage 152 are readily accessible when the spinnerette assembly is removed from the spinning machine, cleaning of the spinnerette is relatively easy. This facilitates cleaning and reduces turnaround time for the spinnerette. Also, core forming material passage 150 can be easily machined in spinnerette body 110 by drilling, and transverse passage 152 can be easily and precisely formed by EDM techniques using an angular electrode. Further, since needle 130 is securely fixed to the spinnerette body into mounting hole 111, alignment of the needle concentrically within upper and lower annular passages 153 and 154 is assured and thus laborious and intricate alignment processes are obviated, thereby further reducing turnaround time.

Figure 3:
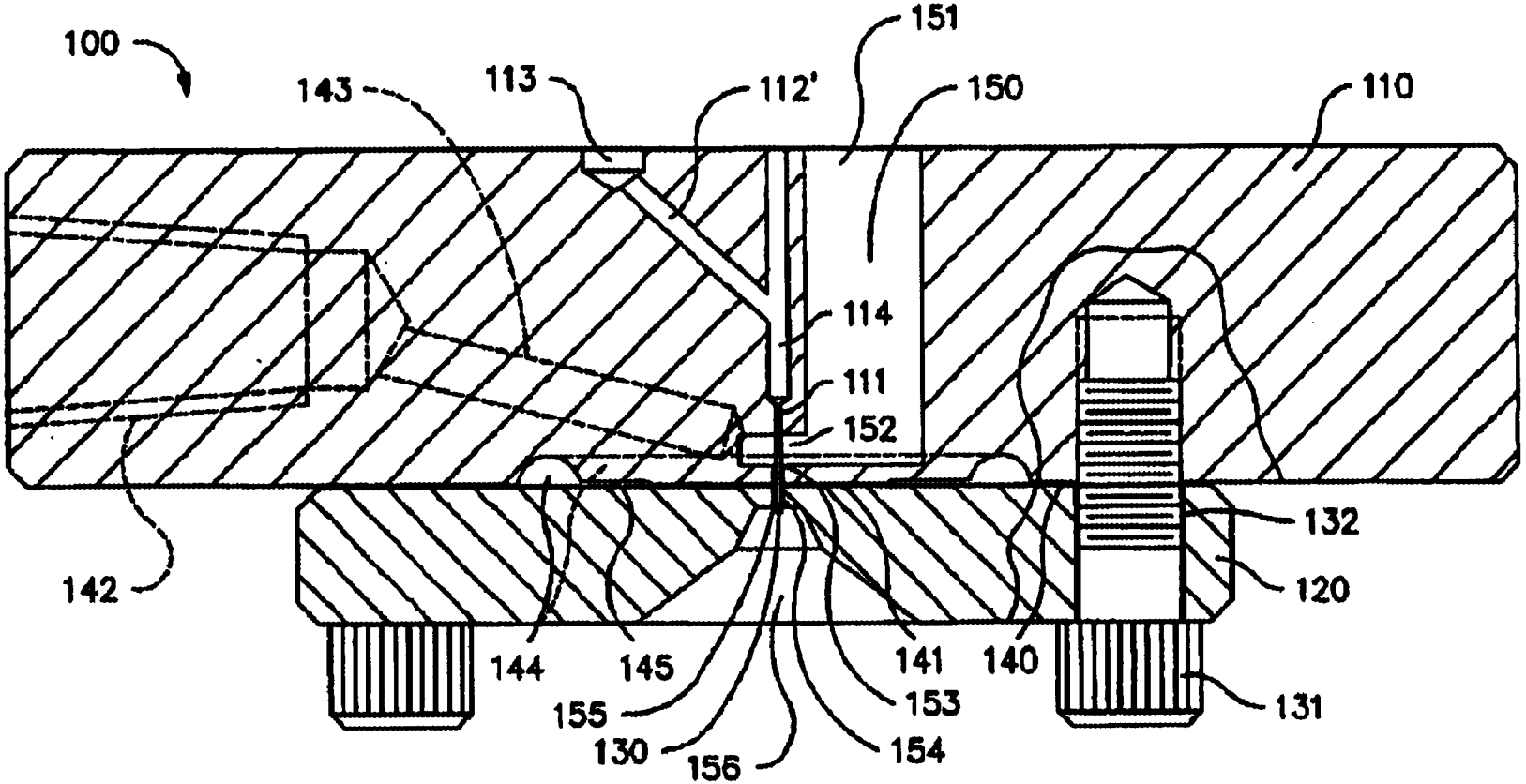
FIG. 3 is an alternative construction of spinnerette body of the first preferred embodiment.

Spinnerette assembly 100 of the preferred embodiment has fewer parts and is more easily manufactured as compared to conventional spinnerettes. FIG. 3 illustrates an alternative construction of the spinnerette body of the first preferred embodiment that further simplifies the spinnerette manufacturing process. In the first preferred embodiment depicted in FIG. 2, bore forming fluid passage 112 must be machined, e.g. drilled, at an angle and with a high degree of precision to accurately meet and communicate with needle mounting hole 111 without damaging the integrity of needle mounting hole 111, which has a relatively small diameter. The spinnerette body of FIG. 3 has an alternative design that obviates this intricate machining step and thus reduces the cost of manufacturing a spinnerette. In particular, a secondary bore forming fluid passage 114 is machined substantially parallel to core forming material passage 150 and extends from the surface of spinnerette body 110 to needle mounting hole 111, and is concentric with needle mounting hole 111. Since secondary bore forming fluid passage 114 is coaxial with needle mounting hole 111, the machining process is greatly simplified. Bore forming fluid passage 112' is machined in spinnerette body 110 so as to originate at bore forming fluid inlet port 113 and intersect with secondary bore forming fluid passage 114 at a point substantially removed from needle mounting hole 111. Angled bore forming fluid passage 112' is readily machined to communicate with secondary bore forming fluid passage 114 (that can be machined prior to machining angled passage 112') because the diameters of angled passage 112' and passage 114 are relatively large as compared to the diameter of needle mounting hole 111. The opening of secondary bore forming fluid passage 114 at the face of spinnerette body 110 can be plugged or otherwise sealed prior to or during mounting of the spinnerette assembly 100 onto the spinning machine to avoid leakage of the bore forming fluid. Other aspects of the alternative design of FIG. 3 are similar to the design of FIG. 2 described above.

Figure 4:
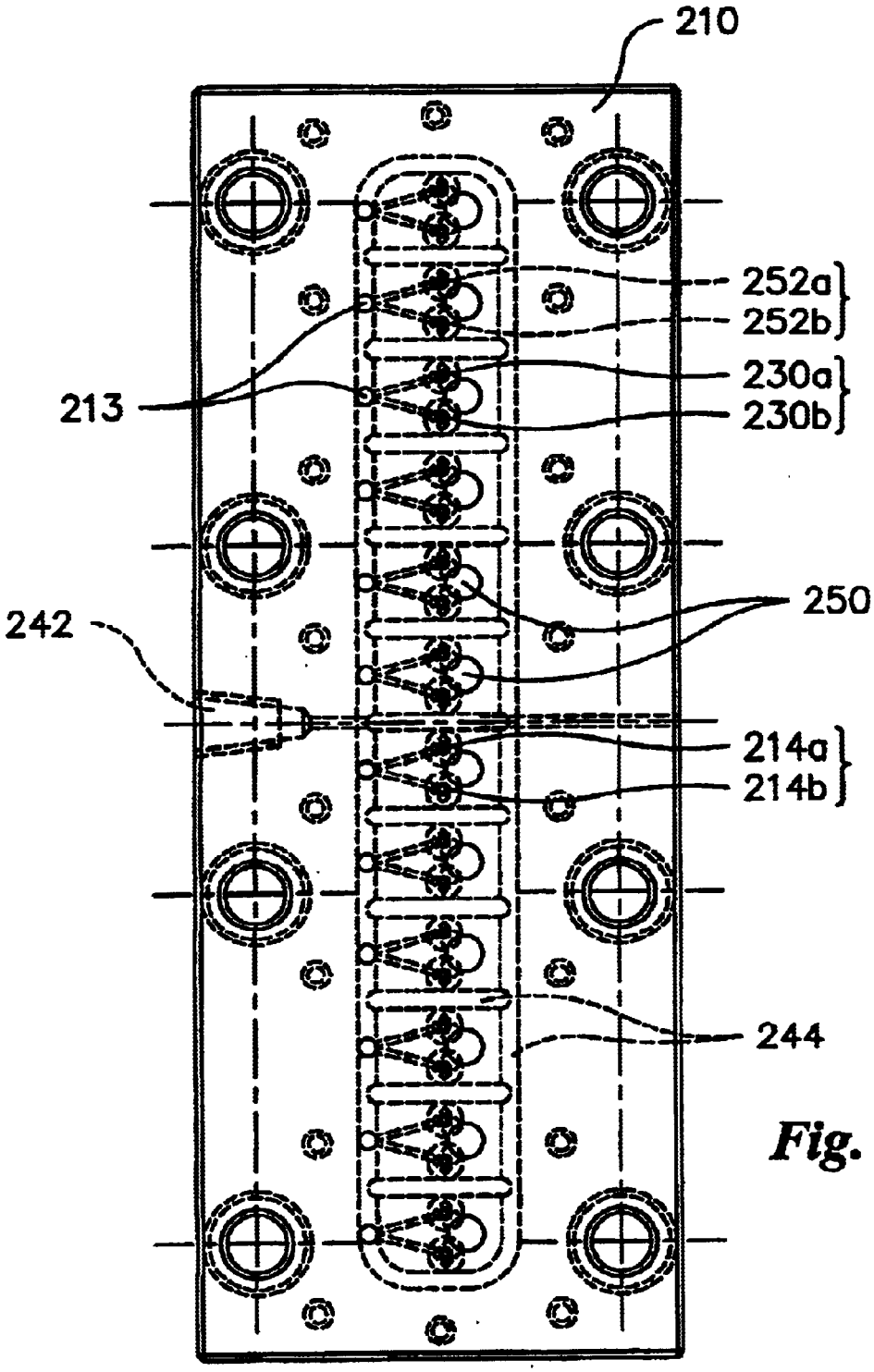
FIG. 4 is a top view of a second preferred embodiment of the invention for spinning multiple filaments from a single core forming material passage.

A second preferred embodiment in accordance with the invention is illustrated in FIG. 4, which depicts a method for increasing the number of fibers per spinnerette by a factor of two. For illustrative purposes and clarity, the numeration used in FIG. 4 is 100 greater than for corresponding components in FIGS. 1, 2, and 3. FIG. 4 is a top view of spinnerette body 210. The distinguishing feature between this embodiment and the one depicted in FIGS. 1, 2, and 3 is that for each core forming material passage 250 are formed two transverse passages **252*a* and 252*b*, each in the form of a backcut portion. Each traverse passage 252***a* and 252*b* are provided with an annular passage 253*a* and 253*b* respectively (corresponding to annular passage 153 in FIGS. 2 and 3), and needles 230*a* and 230*b* (corresponding to needles 130 in FIGS. 2 and 3). Similarly, other features in spinnerette body 110 and bottom plate 120 depicted in FIGS. 1, 2, and 3 are provided as corresponding features in spinnerette body 210 and bottom plate 220. Thus, with reference to FIGS. 3 and 4 the transverse passages 252*a* and 252*b* extend from core forming material passage 250 to the edge of the annular passages 253*a* and 253*b* around each needle 230*a* and 230*b* of the corresponding extrusion orifice. Plural needles 230*a* and 230*b* are disposed in spinnerette body 210 and are in communication with bore forming fluid passage 214*a* and 214*b*. Each needle extends through a corresponding extrusion orifice 255*a* and 255*b* defined by the cylindrical upper and lower annular passages 253*a* and 253*b*, and 254*a* and 254*b* respectively. Channels 244 and 245 formed in the bottom surface of spinnerette body 210 are in communication with gap 241*a* and 241*b* defined between spinnerette body 210 and bottom plate 220. Shim 240 disposed between spinnerette body 210 and bottom plate 220 defines the dimension of gap 241 that provides uniform delivery of the sheath forming material around the core forming material in a concentric fashion at the intersection of gaps 241*a* and 241*b* and annular passages 254*a* and 254*b* respectively. Sheath forming material inlet port 242 and sheath forming material passage 243 are formed in spinnerette body 210 to be in communication with channels 244 to permit sheath forming material to be delivered through sheath forming material inlet port 242 and sheath forming material passage 243, through channels 244 and 245, and through gaps 241*a* and 241*b*. The bore forming fluid is supplied to spinnerette body 210 through bore forming fluid inlet port 213. The bore forming fluid is distributed from each bore forming fluid inlet port 213 through channels 212'*a* and 212'*b* to each bore forming fluid passages 214*a* and 214*b*. Accordingly, the spinnerette assembly 200 can be attached to the same spinning machine to produce twice as many fibers. One skilled in the art can envision additional embodiments to spin fibers in multiples greater than two (e.g., 3, 4, 5) based on the above embodiments.

Figure 5:
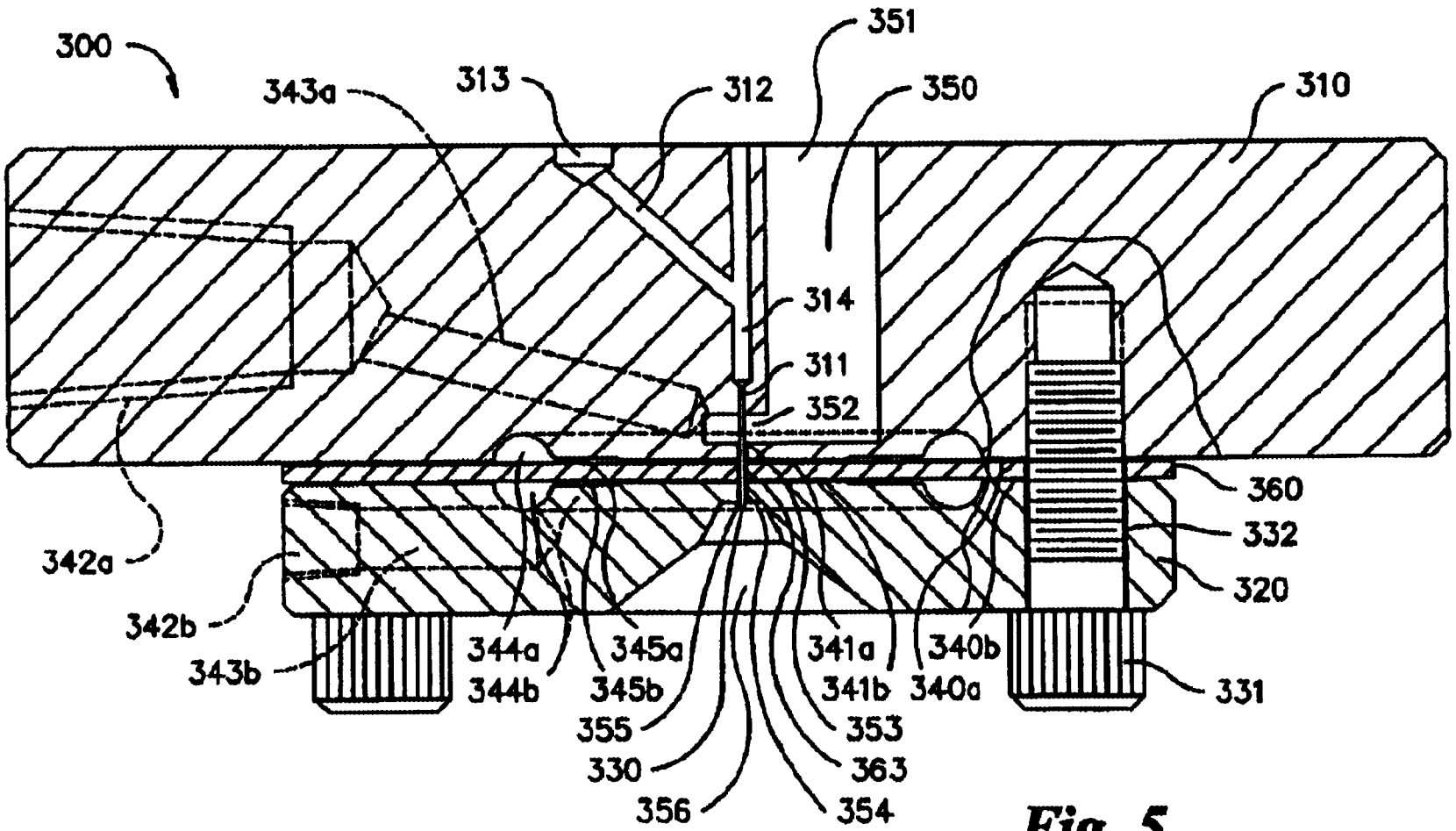
FIG. 5 is a sectional view of a third preferred embodiment of the invention for spinning multiple-sheath hollow fibers.

FIG. 5 illustrates a third preferred embodiment of the invention adapted to make hollow fibers of three components. For illustrative purposes and clarity, the numeration used in FIG. 5 for corresponding components in FIGS. 1, 2, and 3 is 200 greater than that in FIGS. 1, 2, and 3). Spinnerette assembly 300 comprises spinnerette body 310, bottom plate 320, plural needles 330 (one of which is visible in FIG. 5), and middle plate 360 disposed between spinnerette body 310 and bottom plate 320. Shim 340*a* is disposed between spinnerette body 310 and middle plate 360, and shim 340*b* is disposed between middle plate 360 and bottom plate 320. Spinnerette body 310, middle plate 360, bottom plate 320, and shims 340*a* and 340*b* are assembled into a unitary body during use as described in detail below. A proximal end of each needle 330 is secured, e.g., by a pressure fit, in a respective needle mounting hole 311 formed in spinnerette body 310 by drilling or another machining process. Bottom plate 320 and middle plate 360 are secured to spinnerette body 310 by fasteners 331, such as bolts or the like threaded through holes 332, with shim 340*a* defining a gap 341*a*. Additionally, shim 340*b* defines a gap 341*b* between middle plate 360 and bottom plate 320.

Apertures corresponding to annular passages 353, 363, and 354 are formed in spinnerette body, middle plate, and bottom plate respectively through which a core forming material, a core material plus a first sheath forming material, and a core forming material plus a first and second sheath forming material are extruded respectively. This nascent three-component hollow-fiber ultimately exits the spinnerette assembly through extrusion orifice 355. Flared recesses 356 are formed in a bottom surface of the bottom plate 320 to permit each extruded fiber to exit spinnerette assembly 300 without interference for further processing by a spinning machine on which spinnerette assembly 300 is mounted. Channels 344*a* and 345*a* are formed in a bottom surface of spinnerette body 310, and are in communication with gap 341*a*. Channels 344*b* and 345*b* are formed in a top surface of bottom plate 320, and are in communication with gap 341*b*.

Core forming material passages 350 are formed in spinnerette body 310 through which a core forming material, such as a polymer material, is introduced into each extrusion orifice. Each core forming material passage 350 includes core forming material inlet port 351 which is a hole extending in a direction that is substantially parallel to the extrusion orifice. Each core forming material passage 350 also includes transverse passage 352 which extends from core forming material inlet port 351 to a top portion of annular passage 353 which defines an upper portion of the extrusion orifice. Transverse passage 352 is defined by a backcut portion formed in spinnerette body 310 by a tool inserted through core forming material inlet port 350 and extends entirely around needle 330 to permit the core forming material to be evenly introduced into annular passage 353.

Bore forming fluid inlet port 313 and bore forming fluid passages 312 and 314 are formed in spinnerette body 310 to be in open communication with needle mounting hole 311. This arrangement permits a bore forming fluid to be introduced into an extruded fiber to maintain the hollow structure of the extruded fiber in the manner described below.

A first sheath forming material inlet port 342*a* is formed in spinnerette body 310 to be in communication with channels 344*a* to permit a first sheath forming material, such as a polymer material, to be introduced into the first sheath forming material inlet port 342*a*, through first sheath forming material passage 343*a*, into channels 344*a* and 345*a*, through gap 341*a*, and into annular passage 363.

Similarly, a second sheath forming material inlet port 342*b* is formed in bottom plate 320 to be in communication with channel 344*b* to permit a second sheath forming material, such as a polymer material, to be introduced into the second sheath forming material inlet port 342*b*, through second sheath forming material passage 343*b*, into channels 344*b* and 345*b*, through gap 341*b*, and into annular passage 354. Other aspects of the third preferred embodiment are similar to the first preferred embodiment and like elements are labeled with similar numerals having a prefix of "3".

Operation of the third preferred embodiment is similar to the first preferred embodiment. However, the second sheath forming material travels through second sheath forming material inlet port 342*b*, through second sheath forming material passage 343*b*, into channels 344*b* and 345*b*, through gap 341*b*, and into annular passage 354. As second sheath forming material enters annular passage 354, it is deposited uniformly around the material flowing from annular passage 363 (e.g., core forming material coated with first sheath forming material) into annular passage 354. Accordingly, a hollow fiber having a core, a first sheath deposited uniformly on the core, and a second sheath deposited uniformly on the first sheath plus core, all in a concentric manner, is formed.

The various ports, channels, and passages in the spinnerette assemblies described above can be formed in any manner and can be of any number to produce fibers having plural sheaths and core. For example, the core forming material passage can be of any shape or configuration and can comprise plural channels or a single channel. The spinnerette assemblies can be machined using any known techniques such as drilling, electronic discharge machining (EDM), or any other suitable process or processes. There can be any number of extrusion orifices. The invention can be used to make hollow fibers of any type and of any material amenable to extrusion. The various angles and dimensions can be varied to suit the particular application. The spinnerette assemblies can be manufactured of any suitable material such as steel, monel, titanium, aluminum, or alloys thereof. The core forming material and the sheath forming material (s) can be of any type amenable to extrusion such as polymer melts or solutions, ceramic pastes, and the like. The bore forming fluid can be an inert gas or liquid for example.

The invention has been described through preferred embodiments. However, various modifications can be made without departing from the scope of the invention as defined in the appended claims.

What is claimed:

1. A spinnerette assembly for forming one or more composite hollow fibers comprising:

a unitary spinnerette body;

at least one extrusion orifice formed in said unitary spinnerette body;

a hollow needle being affixed in a needle mounting hole formed in said unitary spinnerette body and wherein said needle mounting hole receives a portion of said hollow needle, said hollow needle extending through each said at least one extrusion orifice in a concentric manner to define at least one annular passage around said needle in said at least one extrusion orifice;

a bore forming fluid passage formed in said unitary spinnerette body, said bore forming fluid passage communicating with the interior of each said hollow needle;

at least one core forming material passage formed in said unitary spinnerette body, wherein each said at least one core forming material passage comprises a core forming material inlet port extending from a surface of said spinnerette body to an interior of said unitary spinnerette body and at least one transverse passage extending form said core forming material port to each said at least one annular passage; and a sheath forming material passage formed in said unitary spinnerette body wherein said sheath forming material passage comprises a sheath forming material port extending from a surface of said unitary spinnerette body to each said annular passage.

2. A spinnerette assembly as recited in claim 1, wherein said at least one transverse passage is a backcut portion of said at least one core forming material passage that entirely surrounds said hollow needle in a continuous manner and is in communication with said at least one extrusion orifice.

3. A spinnerette assembly as recited in claim 1, wherein each said core forming material port extends substantially parallel to said at least one extrusion orifice and said at least one transverse passage extends substantially perpendicular to said core forming material port.

4. A spinnerette assembly as recited in claim 1, wherein said spinnerette assembly comprises said unitary spinnerette body and a bottom plate separated from each other by a shim disposed between said unitary spinnerette body and said bottom plate.

5. A spinnerette assembly as recited in claim 4 wherein each said needle mounting hole is in communication with said bore forming fluid inlet port at a surface of said unitary spinnerette body via said bore forming fluid passage.

6. A spinnerette as recited in claim 5, wherein said bore forming fluid passage comprises a first bore forming fluid conduit coaxial with said needle and in communication with said needle and a second bore forming fluid conduit that extends at an angle with respect to said first bore forming fluid conduit from said bore forming fluid conduit to a surface of said unitary spinnerette body.

7. A spinnerette assembly as recited in claim 4, wherein said extrusion orifice extends through portions of said unitary spinnerette body and said bottom plate.

8. A spinnerette assembly as recited in claim 4, wherein said core forming material passage is formed in said unitary spinnerette body.

9. A spinnerette assembly as recited in claim 4, wherein a gap between said unitary spinnerette body and said bottom plate defines a portion of said sheath forming material passage.

10. A spinnerette assembly for forming one or more multiple-sheath composite hollow fibers comprising:

a unitary spinnerette body, at least one extrusion orifice formed in said unitary spinnerette body;

a hollow needle being affixed in a needle mounting hole formed in said unitary spinnerette body and wherein said needle mounting hole receives a portion of said needle, said hollow needle extending through each said at least one extrusion orifice in a concentric manner to define at least one annular passage around said needle in said at least one extrusion orifice;

a bore forming fluid passage formed in said unitary spinnerette body, said bore forming fluid passage communicating with the interior of each said needle;

at least one core forming material passage formed in said unitary spinnerette body, wherein each said at least one core forming material passage comprises a core forming material inlet port extending from a surface of said unitary spinnerette body to an interior of said unitary spinnerette body and at least one transverse passage extending from said core forming material port to each said at least one annular passage; and a first sheath forming material passage, wherein said first sheath forming material passage comprises a first sheath forming material port extending from a surface of said unitary spinnerette body to each said at least one annular passage a second sheath forming material passage, wherein said second sheath forming material passage comprises a second sheath forming material port extending from a surface of said spinnerette assembly to each said annular passage.

11. A spinnerette assembly as recited in claim 10, wherein said transverse passage is a backcut portion of said core forming material passage that entirely surrounds said needle in a continuous manner and is in communication with said extrusion orifice.

12. A spinnerette assembly as recited in claim 10, wherein each said core forming material port extends substantially parallel to said extrusion orifice and said transverse passage extends substantially perpendicular to said core forming material port.

13. A spinnerette assembly as recited in claim 10, wherein said spinnerette assembly comprises a unitary spinnerette body, a middle plate, and a bottom plate separated by a first shim disposed between said unitary spinnerette body and said middle plate, and a second shim disposed between said middle plate and said bottom plate.

14. A spinnerette assembly as recited in claim 13 wherein each said needle mounting hole is in communication with said bore forming fluid inlet port at a surface of said unitary spinnerette body via a bore forming fluid passage.

15. A spinnerette as recited in claim 14, wherein said bore forming fluid passage comprises a first bore forming fluid conduit coaxial with said needle and in communication with said needle and a second bore forming fluid conduit that extends at an angle with respect to said first bore forming fluid conduit from said bore forming fluid conduit to a surface of said unitary spinnerette body.

16. A spinnerette assembly as recited in claim 13, wherein said extrusion orifice extends through portions of said unitary spinnerette body, said middle plate, and said bottom plate.

17. A spinnerette assembly as recited in claim 13, wherein a gap between said unitary spinnerette body and said middle plate defines a portion of said first sheath forming material passage, and the gap between said middle plate and said bottom plate defines a portion of said second sheath forming material passage.

18. A spinnerette assembly as recited in claim 17 wherein said second sheath forming material passage comprises said second sheath forming material inlet port situated at an exterior surface of said bottom plate in communication with a channel formed in said bottom plate, said channel being in communication with the gap defined between said bottom plate and said middle plate.

19. A spinnerette assembly as recited in claims 1 or 10 comprising multiple transverse passages and extrusion orifices for each core forming material port.

* * * * *

UNITED STATES PATENT AND TRADEMARK OFFICE

CERTIFICATE OF CORRECTION

PATENT NO. : 6,746,226 B2
DATED : June 8, 2004
INVENTOR(S) : Samuel E. Moore

It is certified that error appears in the above-identified patent and that said Letters Patent is hereby corrected as shown below:

Column 9,
Line 46, please replace the word “form” with the word -- from --.

Column 10,
Line 45, please replace “passage; and” with -- passage; --.
Line 50, please replace “passage” with -- passage; and --.

Signed and Sealed this

Twenty-third Day of November, 2004

JON W. DUDAS
*Director of the United States Patent and Trademark Office*